US005427273A

United States Patent [19]

Vine

[11] Patent Number: 5,427,273

[45] Date of Patent: Jun. 27, 1995

[54] DISPENSER FOR DISPOSABLE CUPS

[76] Inventor: Menachem Vine, Basht Street 8, Telz Stone, D. N. Harei Yehuda, Israel, 90838

[21] Appl. No.: 198,318

[22] Filed: Feb. 18, 1994

[30] Foreign Application Priority Data

Jul. 16, 1993 [IL] Israel ..... 106374

[51] Int. Cl.[6] ..... G07F 11/16

[52] U.S. Cl. ..... 221/221; 221/283; 221/303

[58] Field of Search ..... 221/155, 221, 199, 283, 221/303, 304, 307, 310

[56] References Cited

U.S. PATENT DOCUMENTS

| | | | |
|---|---|---|---|
| 1,702,573 | 2/1929 | Ringler | 221/303 |
| 1,940,067 | 12/1933 | Wessman | 221/310 |
| 2,315,827 | 4/1943 | Tansley | 221/304 |
| 3,006,503 | 10/1961 | O'Neil | 221/307 |
| 3,121,511 | 2/1964 | Whitehead | 221/283 |
| 3,200,925 | 8/1965 | Swaney | 221/199 X |
| 3,211,329 | 10/1965 | Boyd | 221/283 X |
| 3,373,900 | 3/1968 | Staley | 221/310 X |
| 3,604,592 | 9/1971 | Bacon et al. | 221/303 X |
| 4,079,858 | 3/1978 | Fuss | 221/304 X |
| 4,261,480 | 4/1981 | Fuss | 221/304 |

FOREIGN PATENT DOCUMENTS

| | | | |
|---|---|---|---|
| 106530 | 2/1967 | Denmark | 221/221 X |

*Primary Examiner*—David H. Bollinger
*Assistant Examiner*—Dean A. Reichard
*Attorney, Agent, or Firm*—Philip C. Strassburger

[57] ABSTRACT

The invention provides a dispenser for disposable cups, comprising a mounting plate provided with means for attachment of the dispenser to a vertical surface; and a cup-retaining and dispensing body extending therefrom, the body being provided with an annular opening having a lower edge, and with wedge-like protrusions extending from the inner walls thereof into the opening, the base of the wedge facing the lower edge, and at least a major part of the protrusions being positioned within the same imaginary semi-annular, co-planar segment of the opening; whereby the protrusions, in conjunction with a segment of the inner walls, retain the rim of a downwardly-extending cup to be dispensed, until the removal thereof from the dispenser.

9 Claims, 4 Drawing Sheets

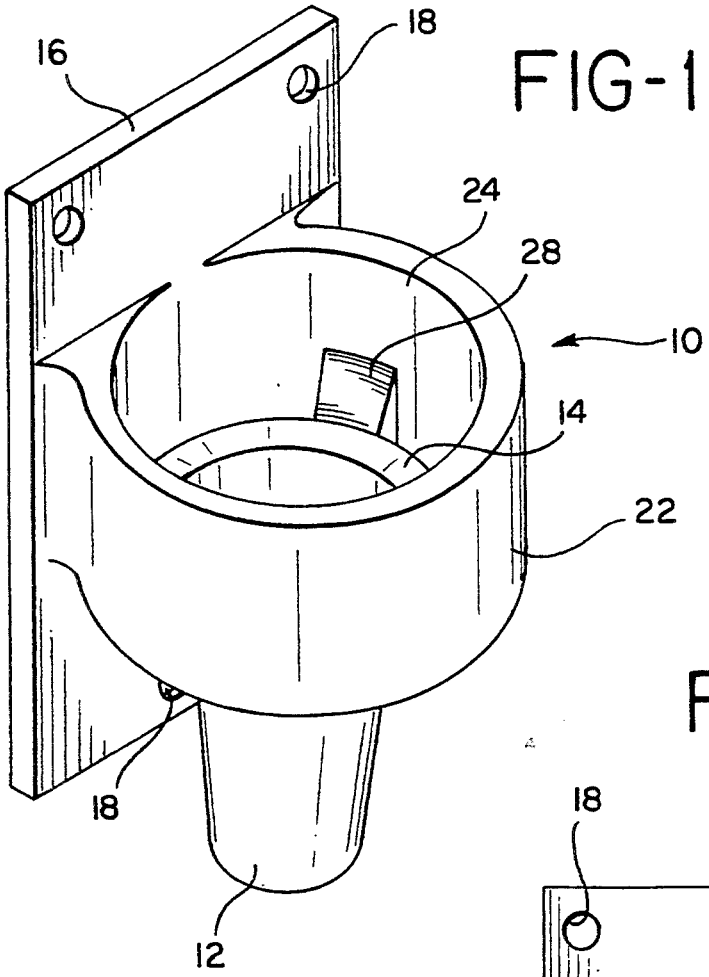
FIG-1
FIG-2
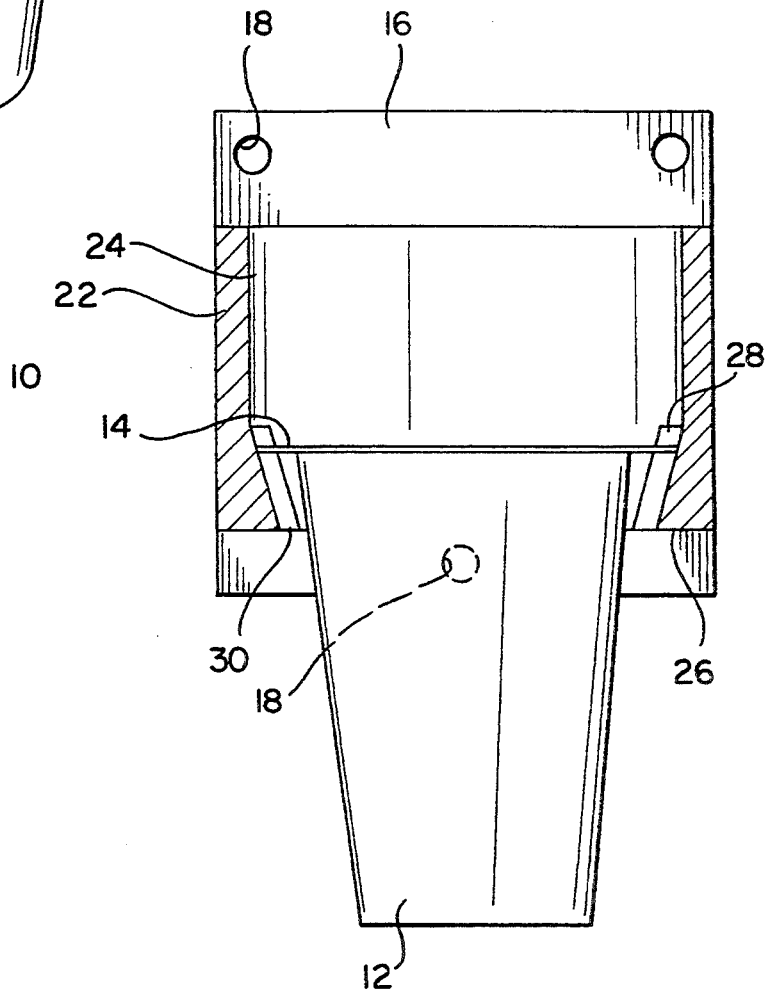

DISPENSER FOR DISPOSABLE CUPS

BACKGROUND OF THE INVENTION

The present invention relates to a dispenser for disposable cups.

More particularly, the invention provides an improved dispenser which is able to dispense tapered, deformable cups, and which holds a stacked column of cups in a convenient position for removal, when required, of the lowest cup.

Users of water coolers, water purifiers and dispensing devices for hot or cold drinks often use disposable, tapered plastic cups. Hot drinks are usually dispensed in thick, foamed-plastic cups, whereas cups made of a thin, solid plastic and having a rim are suitable for cold beverages. Particularly when drinks are provided in offices or in public buildings, the cost of these disposable cups is justified by the saving of cup washing facilities, and in the improved hygiene inherent in providing each user with a new cup.

Tapered cups, of the types described above, can conveniently be stacked in a column to save space, and placed near a water cooler or drink dispenser. The stacked column of cups makes possible the use of a cup dispenser, wherein the cups are protected from dirt and dispersal. Such dispensers may be attached to any vertical surface, and are often directly attached to the water cooler or drink dispenser.

A known cup dispenser comprises a long, tubular housing suspended near its upper opening by a bracket and attached by said bracket to a water cooler or drink dispenser. The lowest cup, which is the first cup to be used, is often inconveniently positioned at a height which requires the user to stoop down in order to remove it from the dispenser.

A further limitation of the known cup dispenser is its inability to retain more than one specified cup size. For example, a cup dispenser of known design intended to be used for cups having a rim of 7.5 cm diameter, will not retain cups having a rim of 7 cm diameter.

It is therefore an object of the present invention to obviate the disadvantages of the prior art cup dispenser, and to provide a cup dispenser which is attachable to a water cooler or drink dispenser, offering the user a cup at a convenient height.

SUMMARY OF THE INVENTION

It is a further object of the present invention to provide a cup dispenser which retains and dispenses cups of different sizes.

The present invention achieves the above objectives by providing a cup dispenser for dispensing disposable cups, comprising a mounting plate provided with means for attaching said dispenser to a vertical surface, and a cup-retaining and dispensing body extending therefrom. The body is provided with an annular opening having a lower edge, and also with wedge-like protrusions extending from the inner walls thereof into said opening, the bases of the wedges facing said lower edge of the opening. At least a major part of each of these protrusions is positioned within the same imaginary semi-annular, co-planar segment of said opening. Said protrusions, in conjunction with a segment of the inner walls of the dispenser body, retain the rim of a downwardly-extending cup to be dispensed until the removal thereof from the dispenser.

In a preferred embodiment of the present invention, there is provided a dispenser for disposable cups, wherein the mounting plate is provided with attachment means, an upper point of attachment being no further than 7 cm from the first horizontal cross-sectional plane of protrusion of the lowest cup from the dispenser.

The invention will now be described in connection with certain preferred embodiments, with reference to the following illustrative figures so that it may be more fully understood.

with specific reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

BRIEF DESCRIPTION OF THE DRAWINGS

In the drawings:

FIG. 1 is a perspective view of a preferred embodiment of the invention;

FIG. 2 is a cross-sectional elevational view of the embodiment of FIG. 1;

DESCRIPTION OF THE PREFERRED EMBODIMENTS

Figure 3:
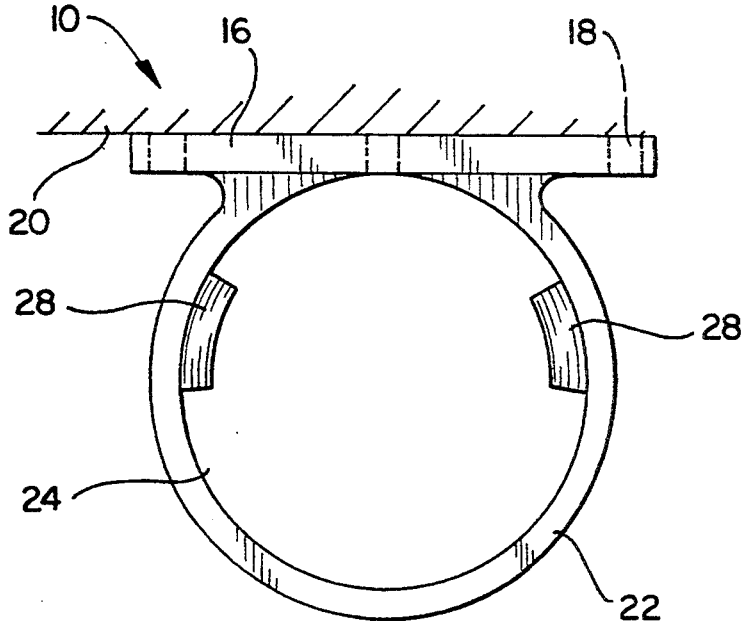
FIG. 3 is a plan view of the embodiment shown in FIG. 1.

There is seen in FIGS. 1, 2 and 3 a dispenser 10 for disposable cups 12. Cups 12 have a rim 14 and a tapered body, and are therefore stackable.

A mounting plate 16 is provided with holes 18 which, together with suitable fasteners (not shown) form the means for attachment of the dispenser 10 to a vertical surface 20, such as a wall or the side of a water or drink dispenser. A cup-retaining and dispensing body 22 extends from mounting plate 16, and is rigidly attached thereto.

In the embodiment shown, mounting plate 16 and the dispensing body are molded in one piece. Many materials are suitable therefor, including an acetal copolymer, glass-reinforced nylon, or a zinc-aluminum alloy suitable for diecasting.

Figure 5A:
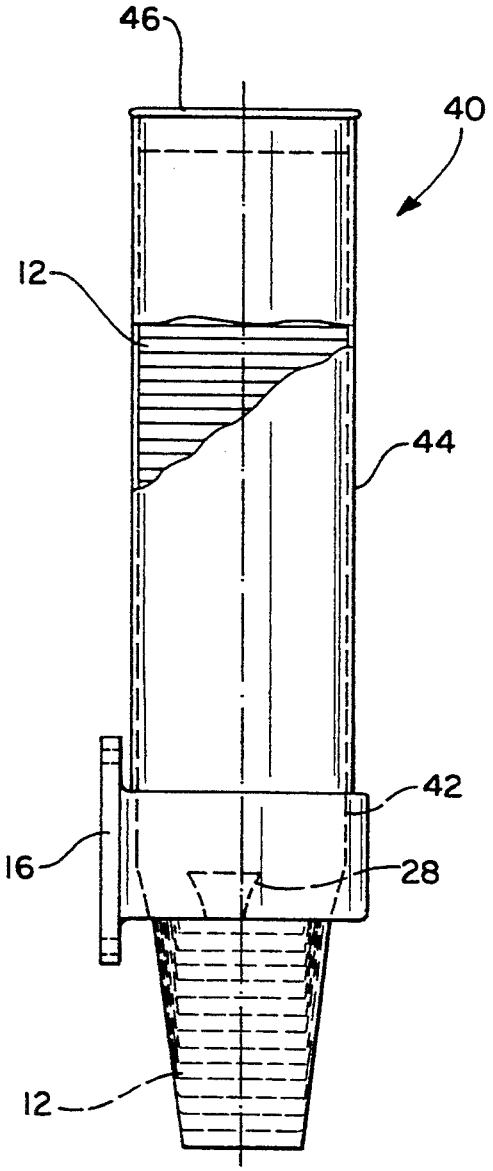
FIGS. 5*a* and 5*b* are side elevational views of separate embodiments of the invention, each loaded with a stacked column of cups and provided with cup housings.

Body 22 is provided with an annular opening 24 having a lower edge 26, opening 24 being sized to allow free passage to cup rim 14. Two wedge-like protrusions 28 extend from the inner walls of opening 24 in the direction of its center. When the dispenser is in use, protrusions 28 contact the rim 14 of the lowest cup 12 and, by preventing its passage, support the stacked column of cups thereabove, as seen in FIG. 5*a*. Bases 30 of the protrusions face lower edge 26, i.e., when the dispenser is assembled, the wedges face downwards.

It will be noted from FIG. 3 that major parts of the protrusions 28 are positioned within the same imaginary semi-annular, co-planar segment of opening 24. In other words, protrusions 28 are not precisely opposite each other. This provides an advantage in facilitating the withdrawal of the lowest cup from the dispenser by simply rocking the cup back and forth to release it from one protrusion and then from the other, without the need to exert a pulling force thereon. Preferably, the slope gradient of protrusions 28 is such that it enables the engagement of cups having rims with diameters between 7.0 and 7.5 cm. An angle of 18° on each protrusion has been found to be suitable.

Figure 4:
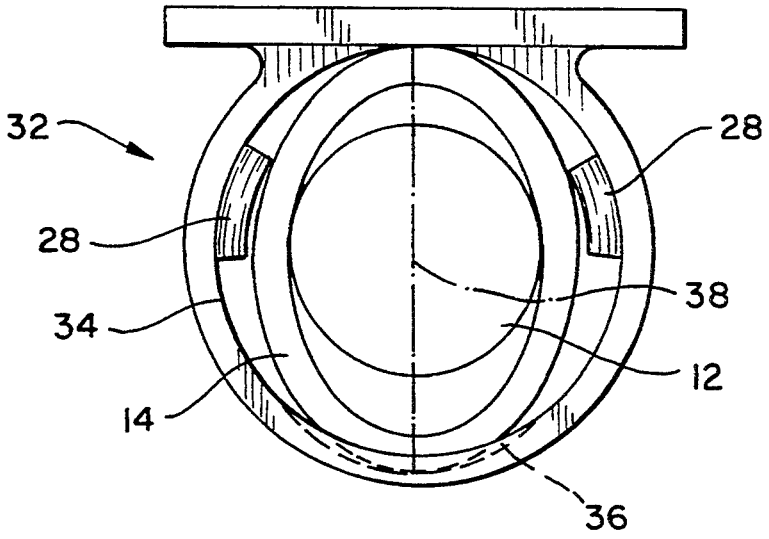
FIG. 4 is a plan view of another embodiment of the invention, shown holding a rimmed cup which is being withdrawn.

FIG. 4 shows a dispenser 32 similar to dispenser 10, but having an inner wall segment of annular opening 34 recessed at 36. The recess facilitates the deformation of rim 14 of cup 12 to be dispensed, during removal thereof from the dispenser. In its undeformed, circular state, rim 14 will not pass protrusions 28. However, when lowest cup 12 is drawn downward by the user, protrusions 28 deform the rim 14 into an elliptical shape, having a major axis 38 larger than the undeformed rim diameter. Recess 36 accommodates the passage of axis 38, thereby easing the withdrawal of cup 12 from the dispenser.

Seen in FIG. 5*a* is a further embodiment 40, which is also similar to dispenser 10, but which has annular opening 42 arranged to accommodate upwardly-extending housing 44 for covering a stacked column of cups 12. Housing 44 is suitably made of an abuse-resistant, transparent polymer such as polyvinylcarbonate. An upper closure 46 is provided, to keep out dirt and to allow recharging with a fresh supply of cups.

Figure 5B:
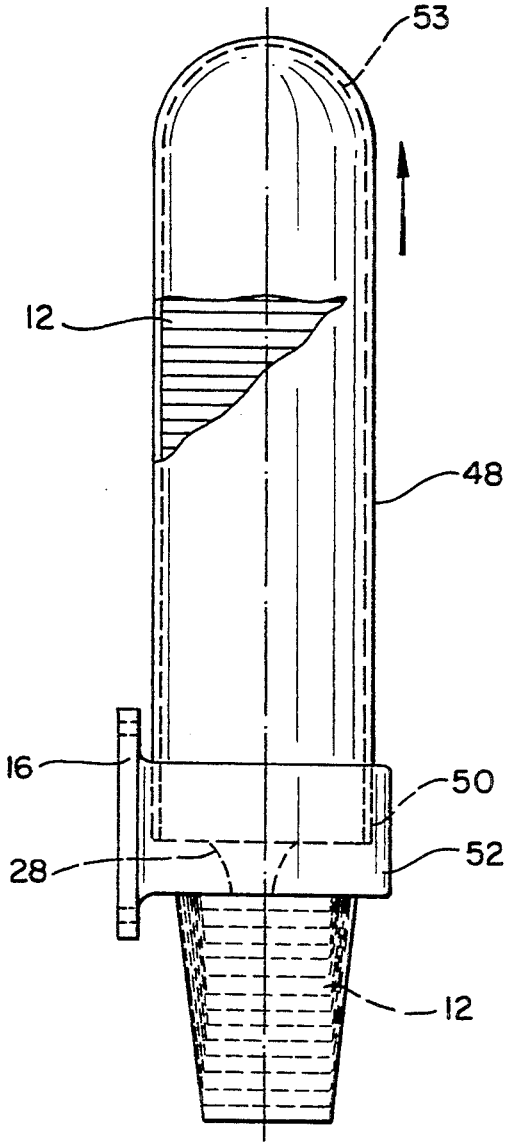

In a further embodiment seen in FIG. 5*b*, an upwardly-extending housing 48 is removably attached in a stepped recess 50 to dispensing body 52. Housing 48 has a closed upper face 53 and requires no additional closure, thus improving hygiene and reducing production cost. Face 53 further serves to structurally strengthen housing 48, which is separated from body 52 for the purpose of insertion of a new stacked column of cups.

Figure 6:
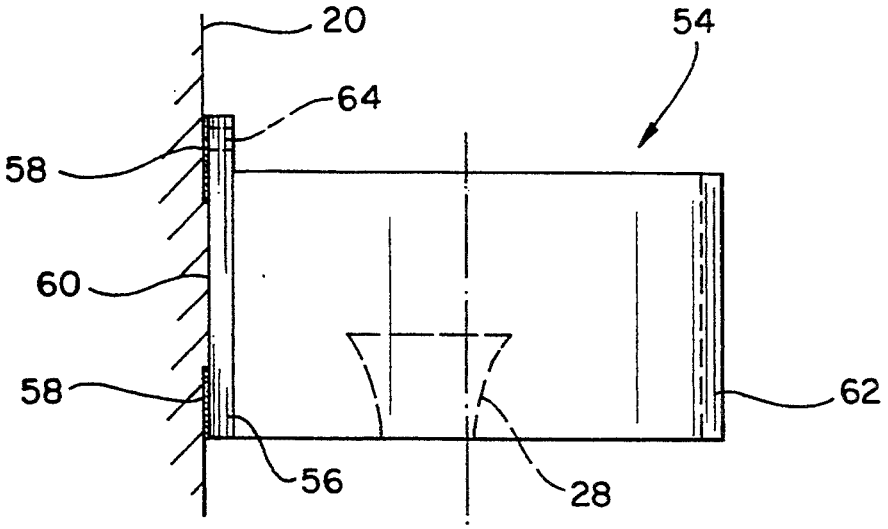
FIG. 6 is a side view of a further embodiment of the invention, for adhesive attachment to a vertical surface.

FIG. 6 shows a further embodiment of a dispenser 54, similar to dispenser 10 but intended for adhesive attachment to a vertical surface 20, such as a wall or a side of a water cooler or drink dispenser. Mounting plate 56 is provided with adhesive surfaces 58 on a face 60 opposite to that having the cup-retaining and dispensing body 62 extending therefrom. A fastening hole 64, for optional use, is also provided near the upper part of plate 56, to secure the dispenser 54 from failure by peeling of the adhesive.

Figure 7:
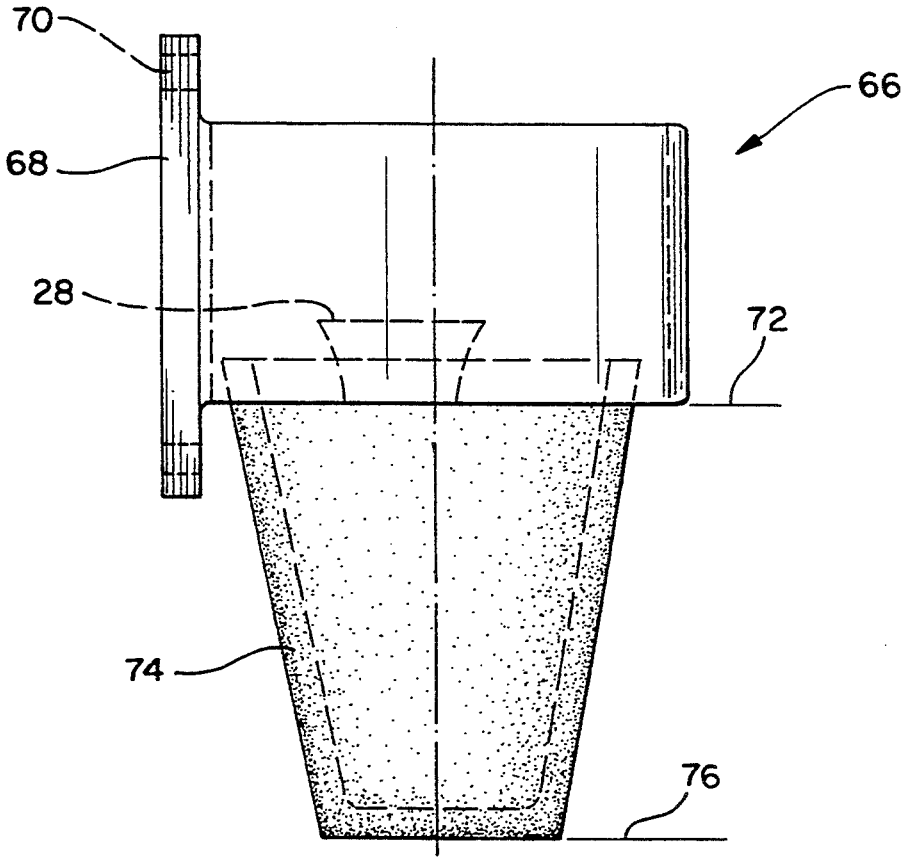
FIG. 7 is a side elevational view of an embodiment holding a foamed plastic cup.

Finally, FIG. 7 depicts a still further embodiment of a dispenser 66, wherein mounting plate 68 is provided with attachment means such as fastener holes 70. The upper attachment hole is no farther than 7 cm from a first horizontal cross-sectional plane of protrusion 72 from the dispenser 66 of a thick-walled foamed plastic cup 74, intended for holding hot drinks. Furthermore, upper fastener hole 70 is no farther than 16 cm from the cross-sectional horizontal plane 76 of the bottom of cup 74 protruding from the dispenser. When the dispenser is made according to the above-stated dimensional limits, and when the dispenser 66 is attached to a water cooler or other beverage dispenser, the lowest cup which is to be removed for use is consequently positioned at a convenient height, so that the user need not stoop down when taking a cup. This convenience is particularly pleasing to elderly people, and is important in hospitals and other locations serving people with physical disabilities.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A dispenser for disposable cups, comprising:

a mounting plate provided with means for attachment of said dispenser to a vertical surface; and a cup-retaining and dispensing body extending therefrom, said body being provided with an annular opening having a lower edge, and with wedge-like protrusions extending from inner walls thereof, the wedge-like protrusions having an apex, an inside face, and a base, wherein the base faces said lower edge and the wedge tapers into said opening from the apex to the base along the inside face, and at least a major part of said protrusions being positioned within the same imaginary semi-annular, co-planar segment of said opening, wherein at least one inner wall segment of said opening is recessed to facilitate the deformation of a rim of a downwardly-extending cup to be dispensed during removal thereof from said dispenser;

whereby said protrusions, in conjunction with a segment of said inner walls, retain a rim of a downwardly-extending cup to be dispensed, until the removal thereof from said dispenser.

2. The dispenser for disposable cups as claimed in claim 1, wherein said protrusions have a slope gradient that enables the engagement of cups having rims with diameters of between 7.0 and 7.5 cm.

3. The dispenser for disposable cups as claimed in claim 1, wherein said dispensing body is further provided with an upwardly-extending housing, for surrounding a stacked column of cups.

4. The dispenser for disposable cups as claimed in claim 3, wherein said housing is removably attached to said dispensing body.

5. The dispenser for disposable cups as claimed in claim 1, wherein said vertical surface is a wall.

6. The dispenser for disposable cups as claimed in claim 1, wherein said vertical surface is a surface of a water cooler or other beverage dispensing device.

7. The dispenser for disposable cups as claimed in claim 1, wherein said mounting plate is provided with adhesive surfaces on a face opposite to that having said cup-retaining and dispensing body extending therefrom.

8. The dispenser for disposable cups as claimed in claim 1, wherein said mounting plate is provided with attachment means, an upper point of attachment being no further than 7 cm from a first horizontal cross-sectional plane of protrusion of said cup from said dispenser.

9. The dispenser for disposable cups as claimed in claim 1, wherein said mounting plate is provided with attachment means, an upper point of attachment being no further than 16 cm from the horizontal cross-sectional plane of the bottom of a cup protruding from said dispenser.

* * * * *